United States Patent [19]

Meyer et al.

[11] Patent Number: 4,523,991

[45] Date of Patent: Jun. 18, 1985

[54] CARRIER PARTICLE FOR THE FROTH FLOTATION OF FINE ORES

[75] Inventors: Wilfred C. Meyer; James J. Jakubowski, both of Midland, Mich.

[73] Assignee: The Dow Chemical Company, Midland, Mich.

[21] Appl. No.: 453,182

[22] Filed: Dec. 27, 1982

[51] Int. Cl.[3] ..... B03D 1/14

[52] U.S. Cl. ..... 209/166; 252/61

[58] Field of Search ..... 209/2, 3, 9, 10, 12, 209/166, 167, 164, 165; 252/61

[56] References Cited

U.S. PATENT DOCUMENTS

| | | | |
|---|---|---|---|
| 2,173,448 | 5/1937 | Katzman | 260/404 |
| 2,173,909 | 6/1937 | Kritchevsky | 209/166 |
| 2,389,763 | 11/1945 | Cahn | 209/166 |
| 2,990,958 | 7/1961 | Greene | 209/166 |
| 3,151,062 | 9/1964 | Duke | 209/3 |
| 3,167,502 | 1/1965 | Duke | 209/12 |
| 3,295,767 | 1/1967 | Becker | 241/19 |
| 3,339,730 | 9/1967 | Boutin et al. | 209/166 |
| 3,425,546 | 2/1969 | Duke | 209/10 |
| 3,459,299 | 8/1969 | Mercade | 209/3 |
| 3,868,318 | 2/1975 | Clark | 209/9 |
| 4,389,306 | 6/1983 | Nakanishi et al. | 209/5 |
| 4,415,445 | 11/1983 | Van Hattem et al. | 209/166 |

FOREIGN PATENT DOCUMENTS

| | | | |
|---|---|---|---|
| 16914 | 10/1980 | European Pat. Off. | 209/166 |
| 168211 | 2/1965 | U.S.S.R. . | |
| 381402 | 3/1973 | U.S.S.R. . | |
| 876172 | 10/1981 | U.S.S.R. | 209/166 |

OTHER PUBLICATIONS

Preprint XIV Int. Mineral Proc. Congress Worldwide Industrial Application of Mineral Proc. Tech. Sheraton Center Hotel Toronto Ontario Oct. 17–23, 1982 Floatation pp. 1–14.

Panu et al., Rev. Minelor, 17 (2) 65–70 (1970).

*Primary Examiner*—Bernard Nozick

*Attorney, Agent, or Firm*—Norman L. Sims

[57] ABSTRACT

This invention is a froth flotation process for beneficiating finely sized mineral matter from a finely sized mineral ore pulp comprising floating the finely sized mineral ore pulp in a frothing aqueous medium comprising a collector and a carrier particle in an effective amount for beneficiating the finely sized mineral matter by flotation, wherein the carrier particles are adapted for selectively floating the finely sized mineral matter. The carrier particles of this invention should have a particle size and a density which are suitable for selectively beneficiating the finely sized mineral ore particles by froth flotation and have a surface treated with a condensation product, or acid derivative of a condensation product, of an alkanolamine with a fatty acid, a fatty acid ester, a dibasic fatty acid or a tribasic fatty acid, in a sufficient amount to render the carrier particle sufficiently hydrophobic to float in the frothing aqueous medium.

15 Claims, No Drawings

CARRIER PARTICLE FOR THE FROTH FLOTATION OF FINE ORES

BACKGROUND OF THE INVENTION

The invention relates to the beneficiation of minerals in fine ore pulps by froth flotation.

Froth flotation is a widely practiced process for separating multicomponent minerals and ores into their components. The process is amenable to a large variety of minerals and ores and provides in many instances, a highly economical and efficacious method for concentrating components of minerals and ores.

There are, however, several limitations to froth flotation processes. One of the most serious drawbacks to these processes is that very finely sized feed, such as feed comprising particles passable through a 200 mesh screen, and particularly those of −10 microns or finer, are not effectively concentrated by froth flotation. Such very fine particles or slimes may be naturally occurring constituents of a mineral or ore or may be artificially produced during the grinding of the mineral or ore to a suitable size for mineral liberation. It is well-known to those skilled in the art that certain materials will not float in a froth flotation process when ground to an exceedingly fine size, although they will float under the same conditions when provided in coarser grain size.

At any rate, those who have heretofore attempted to concentrate components of various finely sized minerals and ores by froth flotation have met with little success. Accordingly, they have advocated desliming prior to flotation, when possible, although such practice adds to the processing costs and loss of valuable mineral. Further, it is general practice to desist, when possible, from grinding certain ores and minerals to a degree at which finely sized minerals or slimes are artificially produced.

In many instances, finely sized minerals or slimes cannot be avoided and removed, when present, for economic or practical reasons. For example, kaolin clay is a naturally slimed mineral, consisting predominantly of particles 2 microns or finer. This clay is mechanically associated with very finely divided color body impurities which detract from the value and utility of the clay in many applications. Prior art efforts to beneficiate the clay by floating the color body impurities have met with mediocre success at best unless the clay feed was prefractionated to reduce the quantity of fines. Certain relatively coarse grained minerals and ores, too, have defied effective froth flotation since they are not readily reduced to suitable flotation feed size without provision of fines when they are ground to overcome interlocking between dissimilar mineral genera to permit their flotation. As examples of ores which become slimed when ground for flotation feed may be cited cassiterite ores, taconite ores, magnesite-brucite ores and uraninite ores (from which concentration of uranium values are desired). Other examples are well-known to those skilled in the art. The technical literature is replete with reports of poor results in beneficiating such slimed minerals and ores by froth flotation without prefractionation or desliming.

One method of beneficiation by froth flotation of the minerals in fine ore pulps is by the use of carrier particles. Greene et al., U.S. Pat. No. 2,990,958, teach a process for the froth flotation of very finely divided multicomponent mineral masses in which the finely divided or slimed feed is conditioned with (1) a reagent capable of selectively oiling a desired component of the feed for entry into the froth during the concentration step, and (2) a particulate auxiliary mineral which is collector-coated (oiled) in a manner such that it is also capable of entry into the froth during the concentration step, thereby enhancing or promoting the flotation of the selectively oiled fraction of the feed. The feed, thus conditioned and in the form of an aqueous pulp is subjected to froth flotation, thereby producing (1) a froth product which is a concentrate of the oiled water-repellent component of the feed in intimate association with the collector-coated water-repellent auxiliary mineral particles and (2) a machine discharge product which is the component of the feed which has not been selectively oiled and is thus water-wettable.

It is taught that any mineral which may be appropriately conditioned for flotation in the presence of a reagentized feed pulp can be used as a carrier particle. Examples given include calcite, bartyes, kyanite, silica sand, anatose and fluorspar. The size of the particles used include between 14 mesh (Tyler standard about 1410 microns) and 5 microns or finer, preferably finer than 325 mesh (about 44.5 microns). The auxiliary mineral is coated with an oriented hydrophobic surface coating, of a character such that the auxiliary mineral will be floatable in the presence of the particular reagentized feed pulp which is being beneficiated. The reagent used as a collector for the minerals can be used to coat the auxiliary mineral. The examples show the use of a soap prepared from tall oil fatty acids and a suitable base as the coating agent.

It is further taught that the optimum amount of the auxiliary mineral may also vary within a wide range. The minimum amount based on the fraction of the feed to be floated is ordinarily at least an equal amount or more by weight. Further, the amount of auxiliary mineral may be equal or double or more by weight of the total feed. After flotation, the auxiliary mineral and component of the feed floated can be separated, and the auxiliary mineral can be reused for flotation after reoiling.

Duke et al., U.S. Pat. No. 3,425,546, teach a process for recycling the carrier described in U.S. Pat. No. 2,990,958. In the process, the nonoiled slimes in the froth are removed from the froth. Preferably this is accomplished by hydraulic sedimentation whereby the nonoiled slime is removed as an aqueous suspension from the oiled constituents which form a sediment. The resulting "washed" froth, which includes oiled carrier particles and an oiled constituent of the feed is filtered and dried at a temperature and for a time sufficient to place the froth residuum in a solid, pulverulent condition but insufficient to decompose or destroy either the oiling reagents or the carrier mineral. The dried froth is pulverized to a finely divided state, producing a product suitable for recycling. A portion of the recycle product is employed in combination with fresh makeup carrier and oiling reagents (for collector-coating the makeup carrier and recycle product) to condition a new charge of finely divided ore pulp for carrier froth flotation. It is taught that unless the froth is dried to pulverulent, substantially bone-dry condition, the recycled product produces poor flotation results.

Clark et al., U.S. Pat. No. 3,868,318, teach that fine particles of a mineral are separated from a mixture of fine particles, by contacting the fine mineral particles with solid bodies (carrier particles) having a mean diameter of at least 10 microns so that the fine particles of the particular mineral are preferentially adsorbed on the surface of the solid bodies, and separating the solid bodies holding the adsorbed fine particles of the mineral from the remainder of the particles. The solid bodies are preferably coarse particles of a granular form or short fibers having a length of from 1 to 2 millimeters. The solid bodies can be treated with surface-active reagents such as a long-chain amine, preferably having at least 8 carbon atoms, or a long-chain polymeric flocculant (number average molecular weight of at least 100,000), for example a polyacrylamide or a polyacrylate salt. The above separation can be done in a froth flotation process.

Unfortunately, none of the above-described references teach a process wherein valuable finely sized mineral matter can be beneficiated by froth flotation in an efficient and economical matter. There is a need for a carrier particle to aid in the beneficiation of finely sized mineral ores by froth flotation which can be recycled without further treatment. There is further needed such a carrier particle which can be used in relatively small amounts, and which can reduce the amount of the frother or collector needed for froth flotation. A carrier particle of a size which can easily be separated from the finely divided mineral ore which has been beneficiated and which does not contribute to the problem of an excessive and stable froth, is desirable.

SUMMARY OF THE INVENTION

This invention is a froth flotation process for beneficiating finely sized mineral matter from a finely sized mineral ore pulp comprising floating the finely sized mineral ore pulp in a frothing aqueous medium comprising a collector, a frother, and carrier particles in an effective amount for beneficiating the finely sized mineral particles wherein the carrier particles are adapted for selectively floating the finely sized mineral particles. The carrier particles of this invention should have a particle size and a density which are suitable for selectively beneficiating the finely sized mineral ore particles by froth flotation and have a surface treated with a condensation product, or acid derivative of a condensation product, of an alkanolamine with a fatty acid, a fatty acid ester, a dibasic fatty acid or a tribasic fatty acid, in a sufficient amount to render the carrier particle sufficiently hydrophobic to float in the frothing aqueous medium and to act as a carrier for the finely sized mineral particles.

Surprisingly, the carrier particles that have been separated from the beneficiated minerals can be reused for flotation without any further processing and treatment. This is a significant advantage over the prior art processes described hereinbefore wherein the carriers discussed required further processing before reuse.

There are several advantages to the invention claimed and described herein. I have discovered the carrier particle size which exhibits the maximum rate of flotation when hydrophobized, that is, treated with the condensate. This discovery allows the use of a surprisingly lower concentration of carrier particles for a particular separation than in the prior art processes. A reduction of the concentration of the carrier particles minimizes the loss in the grade of the recoverable material due to such use.

In this invention, a small amount of condensate is needed to treat the carrier particle. I have discovered the amount which allows maximum flotation of the carrier particles. Also surprising is that this invention allows the use of coarser carrier particles than used in the prior art processes. The use of such particles eliminates excessive and stable froth problems commonly attributed to the presence of fine particles in ore pulps. Further, the use of such carrier particles reduces the level of frother needed, which also aids in reducing the amount and stability of the froth.

DETAILED DESCRIPTION OF THE INVENTION

The alkanolamines useful in this process include those represented by the formula

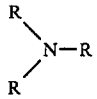

I wherein

R is independently in each occurrence a hydroxyalkyl group or inertly-substituted hydroxyalkyl group having 2 to 5 carbon atoms with the proviso that the hydroxy group is not on the carbon adjacent to the nitrogen, a hydrogen, a $C_{1-4}$ alkyl group, a $C_{1-4}$ alkenyl group or a monovalent group corresponding to the formula

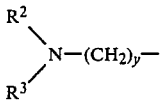

II or

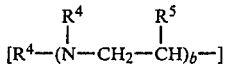

with the further proviso that at least one of the R's must be a hydroxyalkyl of the type defined above, wherein y is an integer of 2 to 3;

$R^2$ and $R^3$ are independently a hydroxyalkyl group or an inertly-substituted hydroxyalkyl group having 2 to 5 carbon atoms with the proviso that the hydroxy group is not on the carbon adjacent to the nitrogen, hydrogen, a $C_{1-4}$ alkyl group or a $C_{1-4}$ alkenyl group;

$R^4$ is independently hydrogen, $C_{1-4}$ alkyl or $C_{1-4}$ hydroxyalkyl.

$R^5$ is independently hydrogen, hydroxy or methyl; and b is an integer of 1 or greater with the proviso that b is of a value such that the molecular weight of the alkanolamine is less than about 1500.

In one preferred embodiment, the hydroxyalkyl group of R is β-hydroxyethyl. In another preferred embodiment, two R's are β-hydroxyethyl and the third R is hydrogen. In still another preferred embodiment, one R is β-hydroxyethyl, a second is β-hydroxyethyl or hydrogen and the third is a univalent group corresponding to the formula

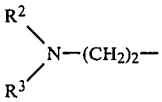

wherein $R^2$ and $R^3$ are separately β-hydroxyethyl or hydrogen with the proviso that either $R^2$ is β-hydroxyethyl or the other two of the R's are β-hydroxyethyl.

In another preferred embodiment, b is between about 2 and 5, inclusive, and $R^4$ is preferably hydroxyethyl or hydrogen and $R^5$ is preferably hydrogen or methyl.

The alkanolamine utilized as a component of the condensation product in the practice of this invention is an unsubstituted or N-alkyl-substituted monoethanolamine; diethanolamine; triethanolamine; β-hydroxyethylethylenediamine; N,N'-di(β-hydroxyethyl)ethylenediamine; N,N-di(β-hydroxyethyl)ethylenediamine; N,N,N'-tri(β-hydroxyethyl)ethylenediamine; N,N,N',N'-tetra(β-hydroxyethyl)ethylenediamine; and like compounds in which the ethylene moiety is replaced by a propylene group and/or the β-hydroxyethyl group is replaced by a hydroxyalkyl group having from 3 to 5 carbon atoms wherein the hydroxy group is not on the carbon adjacent to the nitrogen. For reasons of economics, the hydroxyalkyl group is desirably a hydroxyethyl, 1-methyl(hydroxyethyl) or 1-ethyl(hydroxyethyl) group. However, the above-identified unsubstituted alkanolamines bearing only hydroxyethyl and ethylene moieties are preferred. Diethanolamine, triethanolamine and di-, tri- or tetra(hydroxyethyl)ethylenediamine are especially preferred alkanolamines, with diethanolamine being the most preferred. The alkanolamine can be a single compound or a mixture of operable alkanolamines, with the latter being preferred for economic reasons. The alkanolamines are available commercially or can be readily prepared by the reactions of alkylene oxides with ammonia or an alkylene diamine in a manner known to the art.

The fatty acid condensed with the alkanolamine can operably be a fatty acid having a saturated or unsaturated aliphatic group. The fatty acid can suitably bear hydroxyl substituents on its alkyl portion, but such substitution does not impart any substantial advantage. Fatty acids such as oleic, lauric, linoleic, palmitic, stearic, myristic, mixtures thereof and other like fatty acids are preferred. The esters corresponding to the fatty acids, such as glycerides, are also operable, but less preferred. In some embodiments the fatty acid may be substituted with a second or third carboxylic acid group, making the fatty acid a dibasic or tribasic acid. For reasons of economy, it is preferred to use crude mixtures of fatty acids and rosin acids, lignin and unsaponifiable material, such as tall oil, coconut oil, palm oil, palm kernel oil, cottonseed oil, linseed oil, olive oil, peanut oil, fish oil and the like. Tall oil and tall oil heads are especially preferred mixtures of fatty acids. Tall oil and tall oil heads are well-known compositions described in the *Kirk-Othmer, Encyclopedia of Chemical Technology, 2nd Ed.,* Vol. 19, pp. 614–629 (1969), which is incorporated herein by reference.

The fatty acid or corresponding ester and the alkanolamine can be readily reacted by bringing them together with heating until the desired degree of condensation has taken place as indicated by the water distilled overhead or infrared spectrophotometric analysis of the condensation product. Generally, a temperature of from about 120° C. to about 250° C. is operable. The reaction is termed a condensation herein to distinguish it from the formation of the ammonium salt of the acid at lower temperatures. Dependent on the alkanolamine, the condensation product may be an ester, an amide or both. Although it is desirable that the condensation reaction is substantially complete to make most efficient use of the reactants, the condensation product is operable in the presence of a substantial amount of unreacted fatty acid and the uncondensed alkanolammonium salt of the acid.

Preferably, the molar ratio of fatty acid or fatty acid ester to alkanolamine in the condensation product is between about 0.5:1 and 4.0:1. More preferably, the ratio is between about 1:1 and 2.5:1. Most preferably, the ratio is between about 1:1 and 2:1. The carrier particle may be any solid particle of a size and density suitable for beneficiation of fine minerals by froth flotation, and which may be appropriately conditioned for flotation in the presence of a finely sized mineral ore pulp where the ore pulp has been conditioned for flotation. Desirable sizes for carrier particles include between about 10 and 300 microns, preferably between about 10 and 150 microns. I have discovered that the carrier particle size which demonstrates the maximum rate of flotation when hydrophobized is between about 10 and 150 microns. It is desirable that the carrier particles have a density greater than 1, preferably greater than 1.5. Desirable carrier particles must also be of the type which can be coated with the condensates described above. Examples of carrier particles include: glass, calcite; magnetite; quartz; taconite; transition metals; transition metal oxides and hydrates thereof; group IIIA metals, metal oxides and hydrates thereof; group IVA metals, oxides, metal oxides and hydrates thereof; metal carbonates; sulfides; silicates; and the metals being beneficiated. Preferred carrier particles are transition metal oxides and hydrates thereof; group IIIA metal oxides and hydrates thereof; and group IVA oxides, metal oxides and hydrates thereof. A most preferred carrier particle is alumina trihydrate.

For the carrier particles to aid in the flotation of the minerals in fine ores, they must be treated with the proper amount of the condensates. If too little is used, the carrier particles will not float under flotation conditions because the particles become too hydrophilic and do not adhere to air bubbles. If too much is used, the carrier particles become so hydrophobic that they agglomerate and will not effectively act as carrier particles. Desirable condensate amounts include between about 0.01 and 5 percent by weight of the carrier particle, preferably between about 0.02 and 0.1 percent by weight of the carrier particle. The amount which is best suited for a particular flotation depends upon the type and size of the carrier particle, the mineral to be beneficiated and the size of the particles of the ore pulp.

The carrier particles are treated in a manner such that the condensates described above are adsorbed onto the carrier particles.

In one embodiment, the carrier particles are coated with the condensates. In this embodiment, the carrier surface adsorbs a portion of the condensate, so that the condensate will remain on the surface. The condensates are placed on the carrier particle in the following manner. A slurry of the carrier particles in water is prepared. The condensate is then added, either directly or as an aqueous dispersion if not water-soluble. The slurry is then stirred vigorously to distribute the surface-treating reagent evenly over the surfaces of the carrier particles for between about 5 to 15 minutes.

The slurry is then filtered and centrifuged, and dried for between about 2 to 6 hours, or as appropriate at between about 80° C. to 110° C. The carrier particles may be optionally washed with water prior to drying.

In another embodiment, where the fatty acids or fatty acid esters used are substituted with a second carboxylic acid group, the condensates can be cross-linked on the surface of the carrier particle. In this embodiment the carrier particles are slurried in water. To the slurry is added the alkanolamine-carboxylic acid salt. The slurry is then stirred vigorously for a period of 5 to 15 minutes. The carrier particles upon which the alkanolamine-carboxylic acid salt has been adsorbed are then removed from the water by known methods such as filtering and centrifuging. The dried carrier particles are then heated to between about 120° C. and 200° C. for between about 2 to 4 hours or for such a period as needed to complete the condensation reaction to condense the alkanolamine-carboxylic acid salt on the surface of the carrier. Condensation product herein refers to a product of the reaction wherein a molecule of an alkanolamine and a carboxylic acid react together while liberating a molecule of water. By using fatty acids substituted with additional carboxylic acids, the condensation products will be cross-linked to the carrier particle.

By treating the carrier particles with the condensate described above, the carrier particles become hydrophobic and floatable. Further, the finely sized minerals which have been treated with collectors are attracted to the hydrophobic carrier particles. The collector-treated finely sized minerals attach to the carrier particles which carry them into the froth.

The carrier particles of this invention are useful in beneficiating the finely sized minerals contained in finely sized mineral ore pulps. Some finely sized ore pulps are known in the art as slimes. The particle size in slimes is different in different ores. From a practical standpoint, a finely sized ore pulp is a slime when the size of the ore particles interferes with flotation. Examples of particle sizes in certain slimes include phosphate ores with an average particle size of about 150 microns, copper sulfide ores with an average particle size of about 90 microns, cassiterite ores with an average particle size of less than 6 microns and taconite ores with an average particle size of about 10 microns. The term "finely sized" means herein those particles of the size which create slimes or which have an average particle size of about 10 microns or less. "Finely sized mineral particles" refers herein to those minerals being beneficiated which are finely sized. "Finely sized mineral ore pulps" refers herein to ore pulps which contain a mixture of finely sized particles including the finely sized mineral to be beneficiated.

The present invention, in its broadest aspect, is not limited to the beneficiation of any species or genus of finely sized minerals since its benefits are realized when employing a variety of minerals and ores in which the slime is of natural or artificial origin. This process may be applied with equally good results to feed in which a valued component is concentrated in the froth product or machine discharge product or in which both froth and machine discharge products are valued materials.

Any finely sized mineral may be beneficially conditioned for froth flotation in accordance with the present invention provided the components thereof, which it is desired to separate, are liberated from each other and one of said components must differ from the other to the extent that it contains a substantial amount of a component which is capable of being selectively treated with a suitable collector compound, the collector being held on the surface of the particles of the component by chemical or physical forces or combinations thereof.

Examples of ores which may be beneficiated using the carrier particles of this invention include, cassiterite, phosphate, taconite, wolfamite, tantalite, zircon, columbite, sheelite, magnesite, brurite, and uranite ores, and ores containing copper minerals such as chalcopyrite, chalcocite and cuprite.

The amount of carrier particles used can vary depending upon the particular ore which is beneficiated. A suitable amount of carrier particles is that amount which effectively enhances or improves the beneficiation by flotation of finely sized minerals wherein enhanced means the total recovery is increased or the rate of recovery is increased. A desirable range of concentrations of the carrier particles is between about 0.5 to 20 percent by weight of the feed charge. A preferred range of the carrier particles is between about 1 and 10 percent by weight of the feed charge. The amount of carrier particles which are necessary for this process is substantially less than used in the prior art processes.

After the froth from the froth flotation process has been removed from the flotation cell, the carrier particles can be separated from the finely sized minerals beneficiated by several well-known methods. One method of separation is screening, where the carrier particle size is significantly larger than the size of the particles of the beneficiated ores. Another method of separation is sedimentation. In one embodiment, properly treated carrier particles float only during turbulent conditions suitable for flotation, so that when the froth product is dispersed in water in the absence of such turbulent conditions, the carrier particles settle and the beneficiated minerals would remain dispersed. Another separation method is to hydrocyclone the mixture of carrier particles and beneficiated minerals.

The froth flotation processes in which the carrier particles of this invention are used, are those which are well-known in the art. In most of these processes, the use of collectors and frothing agents are required.

Numerous collectors are known in flotation practice or have been proposed in the technical and patent literature. Generic examples include xanthates, thiocarbamates, dithiophosphates, thiocarbanilide, xanthogen formates, alkylamines, quaternary ammonium compounds, sulfonates and the like. Any collector which is known in the art as suitable for the beneficiation by flotation of a particular mineral ore can be used in this invention. Further blends of known collectors can also be used in this invention.

Suitable frothers include collectors such as fatty acids, soaps, and alkyl aryl sulfonates, but the best frothers are those which have a minimum of collecting properties. They are polar-nonpolar molecules of the type of $C_5H_{11}OH$, amyl alcohol or $C_{10}H_{17}OH$, the active constituent of the well-known frother pine oil. The aliphatic alcohols used as frothers preferably have chain lengths of 5 to 8 carbon atoms, provided there is sufficient branching in the chain. Alcohols in the 10 to 12 carbon atom range are good frothers. Other examples include polyalkylene glycols, polyoxyalkylene paraffins and cresylic acids. Blends of frothers may also be used. All frothers which are suitable for beneficiation of mineral ores by froth flotation can be used in this invention.

SPECIFIC EMBODIMENTS

The following examples are included for illustration and do not limit the scope of the invention or claims. Unless otherwise indicated, all parts and percentages are by weight.

In the following examples, the performance of the frothing processes described is shown by giving the rate constant of flotation and the amount of recovery at infinite time. These numbers are calculated by using the formula $$\gamma = R_\infty \left[ 1 - \frac{1 - e^{-kt}}{kt} \right]$$

wherein: $\gamma$ is the amount of mineral recovered at time t, k is the rate constant for the rate of recovery and $R_\infty$ is the calculated amount of the mineral which would be recovered at infinite time. The amount recovered at various times is determined experimentally and the series of values are substituted into the equation to obtain the $R_\infty$ and k. The above formula is explained in Klimpel et al., "The Engineering Characterization of Flotation Reagent Behavior in Sulfide Ore Flotation", XIV International Mineral Processing Congress, Toronto, Canada, Oct. 17–23, 1982 (incorporated herein by reference).

EXAMPLE 1

Comparative Experiment

Previously sized copper sulfide ore (1000 g) (finer than 10 mesh) from the Cyprus Pima mine in the USA is placed in a rod mill with 600 g of deionized water, 1.3 g of CaO to control pH in the range of 10.5±0.5, and Z®-200 (trademark of The Dow Chemical Company, (isopropyl ethylthionocarbamate) as collector (0.045 kg/metric ton). The mixture is tumbled for 75 minutes until 98.9 percent of the solids pass through a 200 mesh sieve. The slurry is introduced into a flotation machine (specifically, a Galigher Agitair Flotation Machine) having a 3-liter capacity. The cell agitator is run at 900 rpm. DOWFROTH® 1012 (trademark of The Dow Chemical Company), a polypropylene glycol methyl ether having an average molecular weight of about 400, is added to effect a loading of 0.02 kg per metric ton of ore feed. Treated alumina trihydrate particles (10 g, treated as described below) are also introduced at this time and the slurry agitated for 2.0 minutes in a conditioning step, after which aeration of the medium is initiated. The frothy concentrate is collected in trays at time intervals of 0.5, 1.0, 2.0, 3.0, 4.0 and 7.0 minutes using a motorized paddle to remove the froth. The collected concentrate samples are dried in an oven and weighed. Copper analysis of each sample is accomplished by digesting the ore in aqua regia using analytically weighed amounts that are diluted to known volumes and recording the copper concentration from an atomic plasma emission spectrometer.

In a similar manner another charge of copper ore is ground and floated except no alumina trihydrate particles are used. In like manner a third charge of copper ore is ground and floated except no alumina trihydrate particles are used and the frother concentration of DOWFROTH® 1012 is increased to 0.08 kg per metric ton.

SB-31C series alumina trihydrate (Solem Industries) of 90 micron median particle diameter were surface treated in the following manner. A 1:2 molar ratio of diethanolamine and dibasic fatty acid (sold under the tradename Empol 1010 Dimer Acid by Emery Industries) is slurried as 0.1 percent by weight in deionized water. Sufficient alumina trihydrate is added such that the diethanolamine-dibasic acid weight constitutes 0.1 percent of the alumina trihydrate weight. After stirring for 15 minutes, the slurry is rested for 5 minutes and the supernatant liquid decanted from the sediment. The solids of the sediment are dried in an oven and then heated above 140° C. to initiate the condensation reaction between diethanolamine and the carboxylate functionality of Empol 1010 on the surface of alumina trihydrate. A heating time interval of greater than 2 hours is sufficient. The solids are cooled and broken apart using standard methods, such as with roll mills and the like. Table I tabulates the ultimate recovery, rate constant and grade of concentrate recovery in these comparison examples.

TABLE I

| Frother Concentration | R | K | Concentrate Grade |
|---|---|---|---|
| 0.02 kg/t with one percent treated alumina trihydrate based on feed | 0.84 | 8.2 | 5.7% Cu |
| 0.02 kg/t with no treated alumina trihydrate* | 0.83 | 6.7 | 6.3% Cu |
| 0.08 kg/t with no treated alumina trihydrate* | 0.89 | 7.3 | 3.5% Cu |

*Not an embodiment of this invention.

The data in Table I demonstrate the difficulty of increasing the rate of flotation by increasing the amount of frothing agent without carrying substantial amounts of gangue material into the concentrate. Use of the carrier flotation material increased the rate of flotation without substantial loss of grade.

EXAMPLE 2

The surface treated alumina trihydrate as prepared in Example 1 is introduced into deionized water as a 50 percent slurry and boiled for 2 hours. After allowing the solids to settle, the supernatant liquid is decanted and the particles dried in an oven and broken apart using a roll mill. The material is self-floated to test if the surface treatment remains intact from the water boil test. Over 90 percent of the solid is recovered using the float cell and 0.10 kg DOWFROTH® 1012 per metric ton of feed to produce a frothing medium. The concentrate is dried and used for copper ore flotation in the manner of Example 1. The results are tabulated in Table II.

TABLE II

| Example | R | K | Concentrate Grade |
|---|---|---|---|
| 0.02 kg/t DOWFROTH® 1012 with 1 percent refloated alumina trihydrate (treated) | 0.86 | 11.3 | 5.8% Cu |

The data in Table II demonstrates that the surface treatment in Example I is not destroyed by boiling in water and that the carrier particles can be reused with no additional treatment.

EXAMPLE 3

In the manner described in Example 1, iron powder of size passing 100 mesh is slurried in a water dispersion of a diethanolamine condensate with tall oil fatty acid, a 1:2 molar ratio, prepared by standard methods known to those in the art. The monobasic acid is sold under the tradename of Emtall 729 (Emery Industries). A 0.05 percent by weight treatment of iron powder by this dispersion is effected. Flotation of copper ore in the manner of Example 1 is conducted. The results are given in Table III.

TABLE III

| Flotation Condition | R | K | Concentrate Grade |
|---|---|---|---|
| 0.02 kg/t DOWFROTH ® 1012 with 1 percent treated iron powder based on ore feed | 0.81 | 10.9 | 7.1% Cu |

The data in Table III show that a metal such as iron can function as carrier flotation material when treated in the manner taught herein.

EXAMPLE 4

This example illustrates the efficacy of carrier flotation particles in the beneficiation of cassiterite ore fines. A cassiterite ore from Keystone, S.D. of about 0.6 percent $SnO_2$ is ground and fractionated into two size fractions: material passing 230 mesh and retained on 325 mesh (44.5 microns) and slime cassiterite passing 325 mesh. A microflotation cell of 315 ml capacity (7 cm diameter and 11 cm depth in cylindrical form) with an impeller of design equivalent to that of the Agitair Flotation Machine but appropriately scaled is used. Ore (50 g) is conditioned with Aeropromotor 845 from American Cyanamid Company (N-(1,2)-dicarboxyethyl-N-octadecyl sulphosuccinamate), a common collector for cassiterite flotation. The conditioning time is 5 minutes at 2000 rpm agitation. The pH is adjusted to 4.9 using hydrochloric acid before conditioning. DOWFROTH ® 250 (0.06 kg per metric ton feed), a polypropylene glycol methyl ether of about 250 molecular weight, is then added and the slurry conditioned one additional minute. The impeller speed is reduced to 1750 rpm and aeration begun. Frothy concentrate is collected for 5 minutes with a spatula. Air enters the cell via a glass fritted plate at the bottom of the microflotation cell. The concentrate is filtered, dried in an oven, weighed and analyzed for tin content. At a loading of 0.125 kg per metric ton of feed of Aeropromotor 845 results in a recovery of 89 percent $SnO_2$ with a grade of 6.3 percent $SnO_2$ for the coarser fraction of ore (230×325 mesh). On the other hand, the slime cassiterite fraction (minus 325 mesh) recovery is only about 72 percent even with Aeropromotor at a loading of 1 kg per metric ton of feed. The grade is lowered to 3.1 percent. Reducing the level of Aeropromotor 845 to 0.50 kg per metric ton of feed reduces recovery to 49.6 percent and gives a slight improvement in grade (4.2 percent). In a manner similar to this last example, introduction of 10 percent carrier alumina trihydrate particles, prepared in the manner of Example 1, increases cassiterite recovery to 94 percent with a concentrate grade of 3.2 percent. The results are compiled in Table IV.

TABLE IV

| Run | Collector Amount | Ore Particle size | Carrier Particle | % Recovery | Grade |
|---|---|---|---|---|---|
| 1* | 1.0 kg/ton | <325 | no | 72.0 | 3.1 |
| 2* | 0.5 kg/ton | <325 | no | 49.6 | 4.2 |
| 3 | 0.5 kg/ton | <325 | yes 10%** | 94.0 | 3.2 |

*Not an embodiment of this invention.
**10 Percent by weight of the feed.

Runs 1 and 2 demonstrate the beneficiation of the same mineral ore pulp in which finely sized particles are present. This data shows that the recovery of the minerals beneficiated and grade of the minerals recovered are significantly affected by the size of the particles. Runs 1 and 2 also show that the use of much larger amounts of collector will not remedy the low recovery or grade when finely sized particles are present in the ore pulp. Run 3 demonstrates that the use of the carrier particles of this invention increases the recovery of the finely sized minerals contained in the finely sized ore pulp.

What is claimed is:

1. A froth flotation process for beneficiating finely sized metal or phosphate particles from a finely sized mineral ore pulp comprising floating the finely sized mineral ore pulp in a frothing aqueous medium comprising a collector for the finely sized metal or phosphate particles, a frother and carrier particles in an effective amount for beneficiating the finely sized metal or phosphate particles by flotation, wherein the carrier particles comprise glass; calcite; magnetite; quartz; taconite; transition metals; transition metal oxides and hydrates thereof; group IIIA metals, metal oxides and hydrates thereof; group IVA metals, oxides, metal oxides and hydrates thereof; metal carbonates; sulfides; or silicates; and are adapted for selectively floating the finely sized metal or phosphate particles, have a particle size of between about 10 and 300 microns and a density which is suitable for selectively beneficiating the finely sized metal or phosphate particles by froth flotation and, have a surface treated with a condensation product, or acid derivative of a condensation product, of an alkanolamine with a fatty acid, a fatty acid ester, a dibasic fatty acid or a tribasic fatty acid in a sufficient amount to render the carrier particle sufficiently hydrophobic to float in the frothing aqueous medium and to act as a carrier for the finely sized metal or phosphate particles under conditions such that the finely sized metal or phosphate particles and the carrier particles are recovered in the froth wherein the surface of the carrier particle is treated with the condensation product prior to contacting the carrier particles with the frothing aqueous medium, with the proviso that the condensation product with which the carrier particle is treated is a different compound than the compound used as the collector for the metal or phosphate.

2. The process of claim 1 wherein the fatty acid or fatty acid ester is a tall oil fatty acid or a tall oil fatty ester.

3. The process of claim 1 wherein the carrier particle size is between about 10 and 300 microns.

4. The process of claim 1 wherein the carrier particle density is greater than 1.0 $gm/cm^3$.

5. The process of claim 1 wherein the carrier particles are alumina trihydrate.

6. The process of claim 1 wherein the carrier particles are used in an amount between about 0.05 and 20 percent by weight of the finely sized mineral ore pulp to be beneficiated.

7. The process of claim 1 wherein the carrier particles are used in an amount between about 1.0 and 10.0 percent by weight of the finely sized mineral ore pulp to be beneficiated.

8. The process of claim 1 which further includes separating the carrier particles in the froth from the beneficiated ore and, thereafter, reusing the carrier particles for further beneficiation by froth flotation of finely sized material particles in finely sized mineral ore pulp.

9. The process of claim 1 wherein the alkanolamine corresponds to the formula

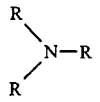

wherein

R is independently in each occurrence a hydroxyalkyl group or inertly-substituted hydroxyalkyl group having 2 to 5 carbon atoms with the proviso that the hydroxy group is not on the carbon adjacent to the nitrogen, a hydrogen, a $C_{1-4}$ alkyl group, a $C_{1-4}$ alkenyl group or a monovalent group corresponding to the formula

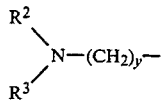

II or

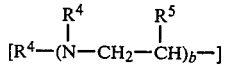

and with the further proviso that at least one of the R's must be hydroxyalkyl of the type defined above, wherein y is an integer of 2 to 3;

$R^2$ and $R^3$ are independently a hydroxyalkyl group or an inertly-substituted hydroxyalkyl group having 2 to 5 carbon atoms with the proviso that the hydroxy group is not on the carbon adjacent to the nitrogen, hydrogen, a $C_{1-4}$ alkyl group or a $C_{1-4}$ alkenyl group;

$R^4$ is independently hydrogen, $C_{1-4}$ alkyl or $C_{1-4}$ hydroxyalkyl;

$R^5$ is independently hydrogen, hydroxy or methyl; and b is an integer of 1 or greater with the proviso that b is of a value such that the molecular weight of the alkanolamine is less than about 1500.

10. The process of claim 9 wherein the alkanolamine is diethanolamine, triethanolamine, di(β-hydroxyethyl-)ethylenediamine, tri(β-hydroxyethyl)ethylenediamine, tetra(β-hydroxyethyl)ethylenediamine or mixtures thereof.

11. The process of claim 1 wherein the molar ratio of fatty acid or fatty acid ester to alkanolamine in the condensation product is between about 0.5:1 and 4.0:1.

12. The process of claim 11 wherein the molar ratio is between about 1:1 and 2.5:1.

13. The process of claim 12 wherein the molar ratio is between about 1:1 and 2:1.

14. The process of claim 1 wherein the carrier particles have been treated with the condensation product, or acid derivative of the condensation product, of an alkanolamine and a fatty acid or fatty acid ester in an amount of between about 0.01 and 0.5 percent by weight of the carrier particle.

15. The process of claim 14 wherein the carrier particles have been treated with the condensation product, or acid derivative of a condensation product, of an alkanolamine and a fatty acid or fatty acid ester in an amount of between about 0.02 and 0.1 percent by weight of the carrier particle.

* * * * *